US010559922B2

(12) United States Patent
Johnson et al.

(10) Patent No.: US 10,559,922 B2
(45) Date of Patent: Feb. 11, 2020

(54) ELECTRICAL CONNECTOR FOR CABLES CONTAINING BOTH POWER AND CONTROL CONDUCTORS

(71) Applicant: Hubbell Incorporated, Shelton, CT (US)

(72) Inventors: Steven James Johnson, Buchanan, MI (US); Jason Peter Thomas, Mesa, AZ (US)

(73) Assignee: HUBBELL INCORPORATED, Shelton, CT (US)

( * ) Notice: Subject to any disclaimer, the term of this patent is extended or adjusted under 35 U.S.C. 154(b) by 0 days.

(21) Appl. No.: 16/219,469

(22) Filed: Dec. 13, 2018

(65) Prior Publication Data

US 2019/0123488 A1 Apr. 25, 2019

Related U.S. Application Data

(63) Continuation of application No. 15/713,097, filed on Sep. 22, 2017, now Pat. No. 10,170,860.

(Continued)

(51) Int. Cl.
*H01R 13/631* (2006.01)
*H01R 31/08* (2006.01)

(Continued)

(52) U.S. Cl.
CPC ..... *H01R 13/6315* (2013.01); *H01R 4/22* (2013.01); *H01R 4/4818* (2013.01);

(Continued)

(58) Field of Classification Search
CPC .... H01R 31/08; H01R 31/085; H01R 13/631; H01R 13/6315; H01R 13/46; H01R 13/64;

(Continued)

(56) References Cited

U.S. PATENT DOCUMENTS 4,516,817 A * 5/1985 Deters ..... H01R 31/08 439/387
4,602,834 A * 7/1986 Hahn ..... H01R 31/08 439/510

(Continued)

OTHER PUBLICATIONS

International Search Report and Written Opinion mailed in corresponding application PCT/US17/53013 dated Dec. 7, 2017 (6 pages).

(Continued)

*Primary Examiner* — Gary F Paumen
(74) *Attorney, Agent, or Firm* — Wissing Miller LLP

(57) ABSTRACT

A connector for connecting control conductors provided in conduits also containing power conductors, the connector including a first guide for receiving a first at least one control conductor provided in a first conduit also containing at least one power conductor, a second guide for receiving a second at least one control conductor provided in a second conduit also containing at least one power conductor, at least one jumper for electrically connecting the first at least one control conductor and the second at least one control conductor and a housing for containing the first guide, second guide and the at least one jumper.

27 Claims, 13 Drawing Sheets

Related U.S. Application Data

(60) Provisional application No. 62/398,860, filed on Sep. 23, 2016.

(51) Int. Cl.

| | |
|---|---|
| ***H01R 4/22*** | (2006.01) |
| ***H01R 4/48*** | (2006.01) |
| ***H01R 9/24*** | (2006.01) |
| ***H01R 13/50*** | (2006.01) |
| ***H01R 13/506*** | (2006.01) |
| ***H01R 13/46*** | (2006.01) |
| ***H01R 13/64*** | (2006.01) |
| ***H01R 13/66*** | (2006.01) |

(52) U.S. Cl.
CPC ..... *H01R 9/2416* (2013.01); *H01R 13/46* (2013.01); *H01R 13/501* (2013.01); *H01R 13/506* (2013.01); *H01R 13/64* (2013.01); *H01R 13/66* (2013.01); *H01R 31/08* (2013.01); *H01R 31/085* (2013.01)

(58) Field of Classification Search
CPC .... H01R 13/66; H01R 13/501; H01R 13/506; H01R 4/22; H01R 4/4818; H01R 9/2416
USPC ..... 439/507, 513, 510, 441, 380, 381, 689, 439/686, 687
See application file for complete search history.

(56) References Cited

U.S. PATENT DOCUMENTS 5,033,976 A * 7/1991 Sarian ..... H01R 13/5829 439/467
5,435,747 A * 7/1995 Franckx ..... H01R 4/2433 439/409
5,545,054 A * 8/1996 Benes ..... H01R 13/422 439/465
5,675,940 A * 10/1997 Bahar ..... E04D 13/031 52/200
5,782,655 A * 7/1998 Stefaniu ..... H01R 13/11 439/510
5,975,940 A 11/1999 Harmann et al.
6,024,605 A * 2/2000 Beck, Jr. ..... H01R 13/424 439/595
6,132,238 A * 10/2000 Hartmann ..... H01R 4/4818 439/439
6,419,368 B1 * 7/2002 Guttenberger ..... B60R 1/07 359/872
6,544,070 B1 * 4/2003 Radliff ..... H01R 4/2433 439/467
6,695,639 B2 * 2/2004 Castaldo ..... H01R 24/28 439/465
6,761,589 B2 * 7/2004 Venditti ..... H01R 13/506 439/596
6,783,386 B2 * 8/2004 Clement ..... H01R 13/5812 439/467
7,080,985 B2 * 7/2006 Hopper ..... H01R 13/625 174/86
7,101,218 B2 * 9/2006 Castaldo ..... H01R 13/5829 439/467
7,140,905 B2 * 11/2006 Castaldo ..... H01R 13/5833 439/410
7,798,846 B2 * 9/2010 Yuan ..... H01R 31/08 439/510
7,927,129 B2 * 4/2011 Gimbel ..... H01R 13/5829 439/467
7,938,677 B1 * 5/2011 Zhu ..... H01R 31/08 439/510
8,109,799 B2 * 2/2012 Schlipf ..... H01R 13/432 439/736
8,814,605 B2 * 8/2014 Yu ..... H01R 13/055 439/689
8,979,574 B2 * 3/2015 Daily, Jr. ..... H01R 4/2433 439/467
9,130,295 B2 * 9/2015 Nguyen Nhu ..... H01R 13/447
9,496,660 B2 * 11/2016 Kao ..... H01R 24/28
9,590,363 B2 * 3/2017 Wu ..... H01R 13/6585
2004/0038582 A1 * 2/2004 Clement ..... H01R 13/5812 439/467
2010/0124395 A1 * 5/2010 Lin ..... G02B 6/3817 385/76
2010/0233900 A1 * 9/2010 Gimbel ..... H01R 13/5829 439/467
2013/0022318 A1 * 1/2013 Fingler ..... G02B 6/4292 385/78
2014/0170897 A1 * 6/2014 Nonen ..... H01R 13/5829 439/467
2016/0079714 A1 * 3/2016 Wu ..... H01R 13/6585 439/607.05
2016/0187591 A1 * 6/2016 Fortusini ..... G02B 6/3821 385/77

OTHER PUBLICATIONS

WAGO Corporation Brochure, "Electrical Installation Products: Splicing Connectors and Chassis Mount Terminal Blocks", 28 pages, Jul. 5, 2016 (based upon Internet archive Wayback machine.).

* cited by examiner

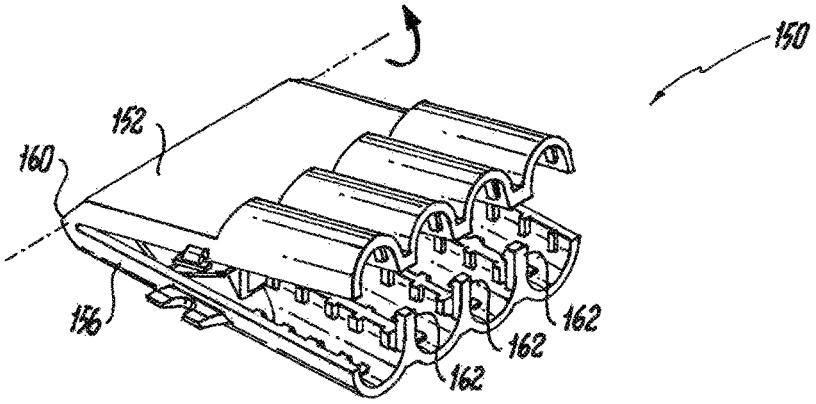
Fig. 4
Fig. 5
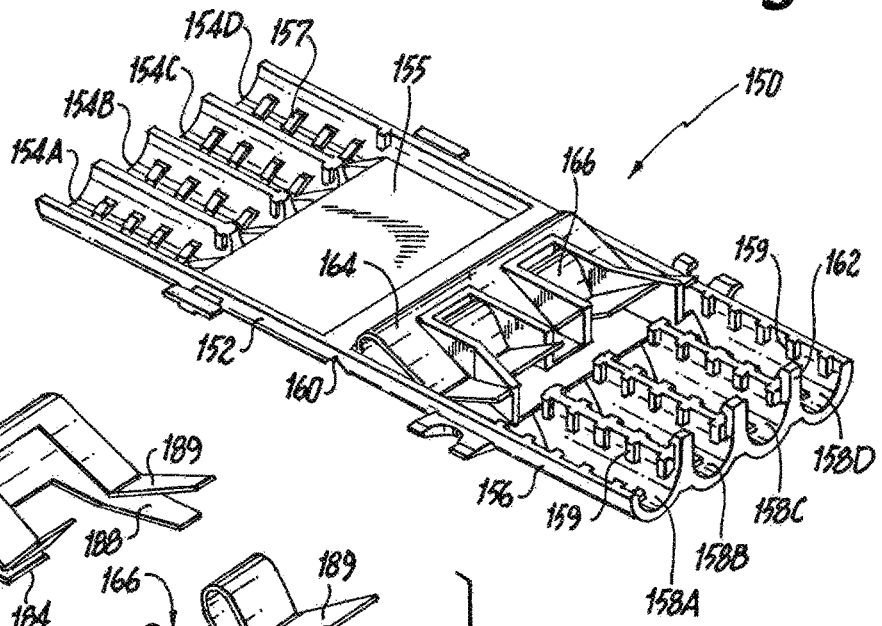
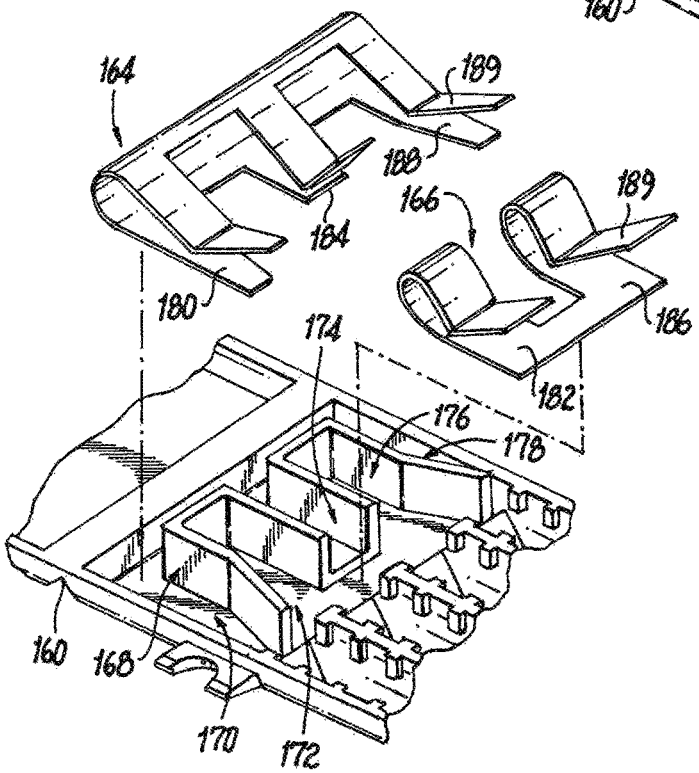
Fig. 6

Fig. 13
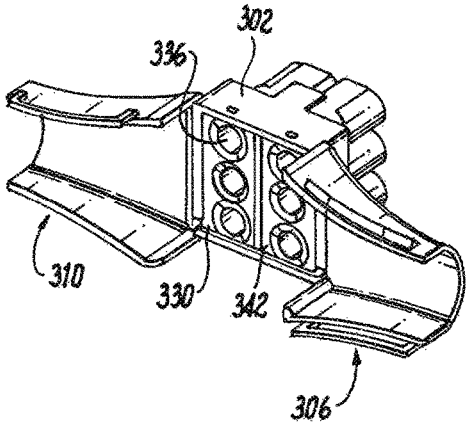
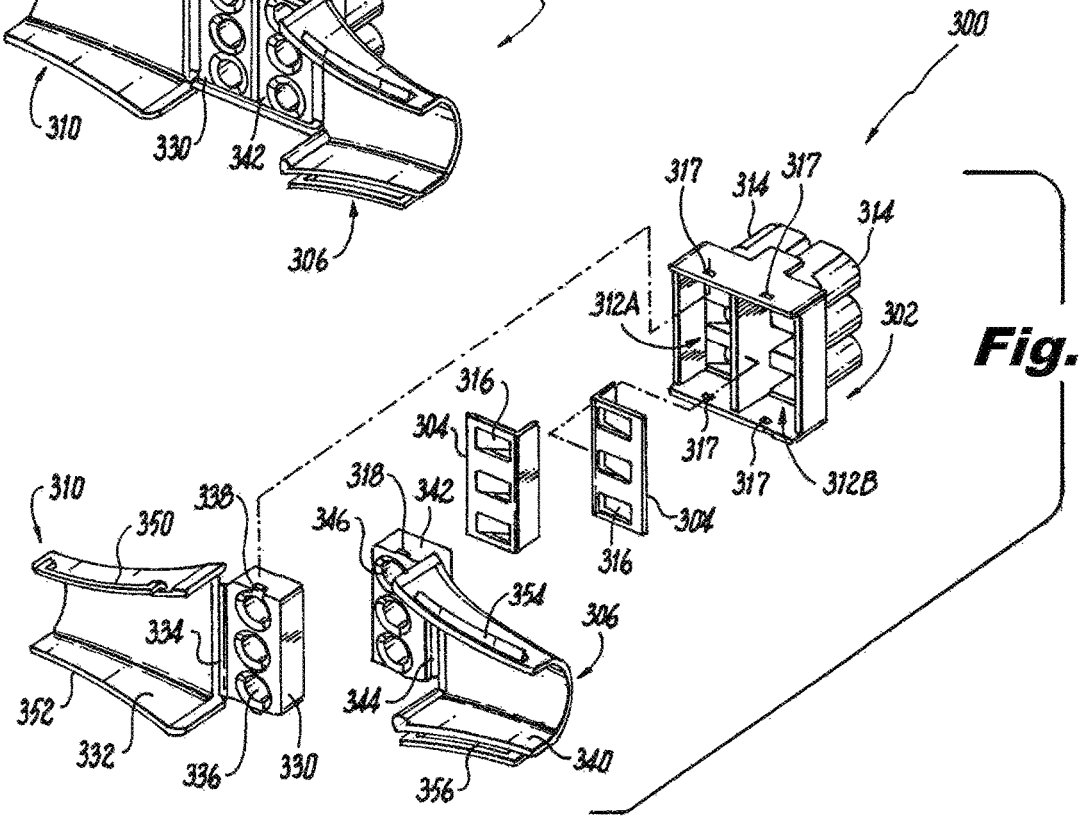
Fig. 14
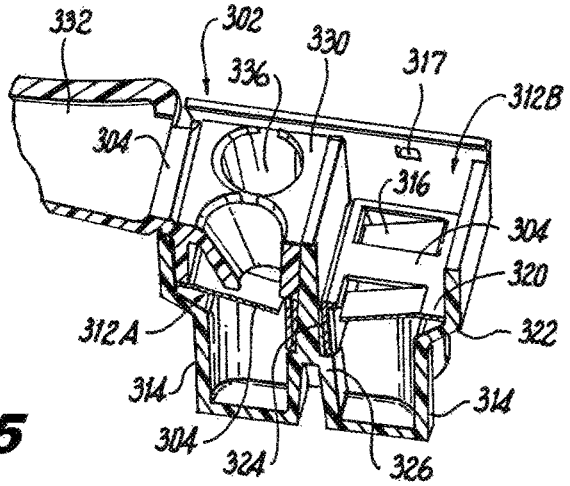
Fig. 15

ELECTRICAL CONNECTOR FOR CABLES CONTAINING BOTH POWER AND CONTROL CONDUCTORS

CROSS REFERENCE TO RELATED APPLICATIONS

This application is a continuation of co-pending application Ser. No. 15/713,097, filed Sep. 22, 2017 entitled "Electrical Connector for Cables Containing Both Power and Control Conductors," which claims priority to U.S. Provisional Application Ser. No. 62/398,860 filed Sep. 23, 2016 entitled "Electrical Connector for Cables Containing Both Power and Control Conductors" the contents of both are incorporated herein by reference in their entirety.

BACKGROUND

Field

The present disclosure relates generally to electrical connectors for cables, and more particularly to electrical connectors for cables containing both power and control conductors.

Description of the Related Art

More and more buildings, homes, etc. are being built utilizing smart building technology. Such smart building technology includes but is not limited to Light-Emitting-Diode (LED) lighting, fluorescent lighting including dimming systems as well as other power, control and signal circuits. To control smart building technology, generally low voltage control/signal wiring (sometimes referred to generally as low voltage wiring or control conductors) and line voltage wiring (sometimes referred to generally as power conductors) are run throughout the building, home, etc.

Current electrical code requires a divider to exist in a junction box to electrically isolate the low voltage wiring (e.g., generally 42.4V AC max or 30V DC max) from the line voltage (typically 120-277 VAC) power-circuit wiring and connectors. This divider is generally a thin plastic or metal wall. The wire runs for control/signal circuits and power circuits are also required to be in separate conduit or separate metal-sheathed cables.

Recently, approved cables have been introduced to the market that have a double insulated low voltage set of wires and a single insulated set of line voltage wires. An example of such a cable is an MC-PCS Cable 10 as shown in FIG. 1. The set of low voltage wires A1, A2 are individually insulated by insulating sleeves 14 and a second insulating sleeve or jacket 16 surrounds the set. This double insulated set and a full set of line voltage wires (single insulated wires 18 (line), 20 (neutral), 22 (ground)) are run all in the same protective conduit/metal-sheathed cable 24 to save cost. Separator tape 23 may be provided between the wires and the inside of the cable 24. Depending on the environment the cable 24 is to be used in, a polyvinyl chloride (PVC) coating 25 may also be provided The low voltage wires typically carry control signals such as control signals used for LED lighting systems or other smart building technology.

The low voltage wires are generally smaller in diameter than the line voltage wires. For example, the line voltage wires are generally 10 to 14 gauge while the low voltage wires are generally 18 to 24 gauge. The line voltage wires and the low voltage wires may be solid or stranded depending on a particular application.

Since low voltage wires are run in the same conduit as line voltage wires, there is a concern that electricity from the line voltage wires may jump to the low voltage wires, which may cause hazardous conditions such as fire or equipment damage. The National Electrical Code that governs separation of cables of this type is NEC Section 725.136. This code requires either 1) a separation of 0.25" between the low voltage wires and line voltage wires, or 2) the insulation of the low voltage wires have the same insulation factor as those used for line voltage wires, e.g., 30 mil jacket over the low voltage wires, which is the same cumulative thickness as those used for line voltage wires.

Low voltage wires inside the same conduit as the line voltage wires satisfy the code by using the same 30 mil insulation jacket to achieve the same insulation thickness as the line voltage wires. However, inside an electrical junction box where the low-voltage wires are typically stripped and spliced with other low-voltage wires, the code requirement to maintain the integrity of the cumulative insulation thickness cannot be satisfied with the same insulator type because some of the insulation jacket has been stripped off. Thus, there is a need for a termination connection device that satisfies the insulation thickness or spacing requirement for these types of jacketed sets of insulated control conductors from the high-voltage power conductors of the unsheathed portions of these cables.

SUMMARY

A connector for connecting control conductors provided in conduits also containing power conductors, the connector including a first guide for receiving a first at least one control conductor provided in a first conduit also containing at least one power conductor, a second guide for receiving a second at least one control conductor provided in a second conduit also containing at least one power conductor, at least one jumper for electrically connecting the first at least one control conductor and the second at least one control conductor and a housing for containing the first guide, second guide and the at least one jumper.

In another exemplary configuration a connector is disclosed for connecting control conductors provided in conduits including sets of line conductors having a first insulation factor. The connector includes a housing and a plurality of jumpers situated within the housing for connecting control conductors from a plurality of conduits. The housing provides a same insulation factor for the control conductors as the first insulation factor.

BRIEF DESCRIPTION OF THE DRAWINGS

A more complete appreciation of the present disclosure and many of the attendant advantages thereof will be readily obtained as the same becomes better understood by reference to the following detailed description when considered in connection with the accompanying drawings, wherein:

FIG. 4 is a perspective view of a cable connector according to an illustrative embodiment of the present disclosure in a partially open position;

FIG. 5 is a perspective view of a cable connector according to an illustrative embodiment of the present disclosure in the open position;

FIG. 6 is a magnified exploded view of a portion of a cable connector according to an illustrative embodiment of the present disclosure;

FIG. 13 is a perspective view of a cable connector according to an illustrative embodiment of the present disclosure in the open position;

FIG. 14 is an exploded view of a cable connector according to an illustrative embodiment of the present disclosure;

FIG. 15 is a partial cut-away view of a cable connector according to an illustrative embodiment of the present disclosure;

DETAILED DESCRIPTION

The following illustrative embodiments are set forth to aid in an understanding of the subject matter of the present disclosure, but are not intended, and may not be construed, to limit in any way the claims which follow thereafter. Therefore, while specific terminology is employed for the sake of clarity in describing some exemplary embodiments, the present disclosure is not intended to be limited to the specific terminology so selected, and it is to be understood that each specific element includes all technical equivalents which operate in a similar manner.

Figure 2:
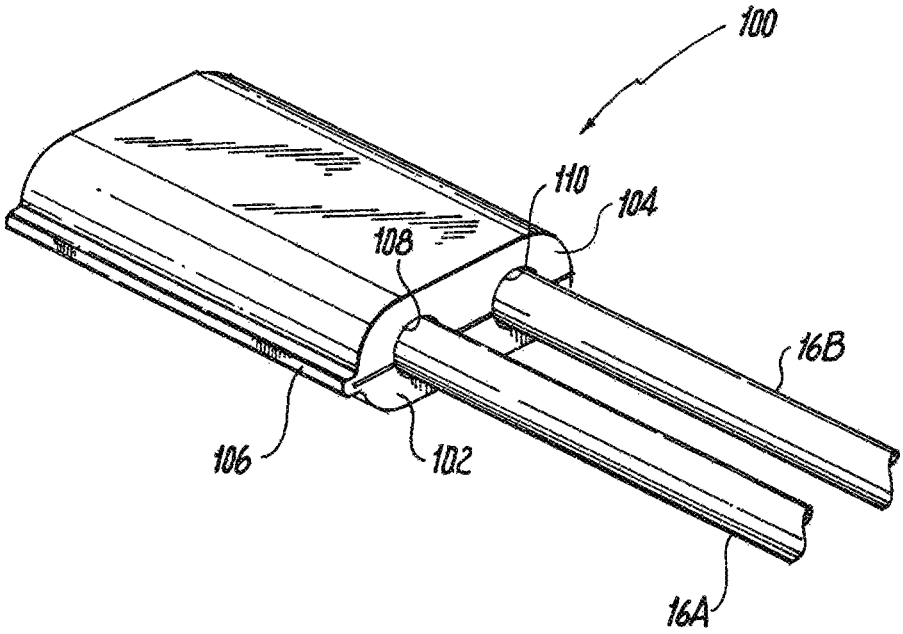
FIG. 2 is a perspective view of a cable connector according to an illustrative embodiment of the present disclosure in the closed position.
Figure 3:
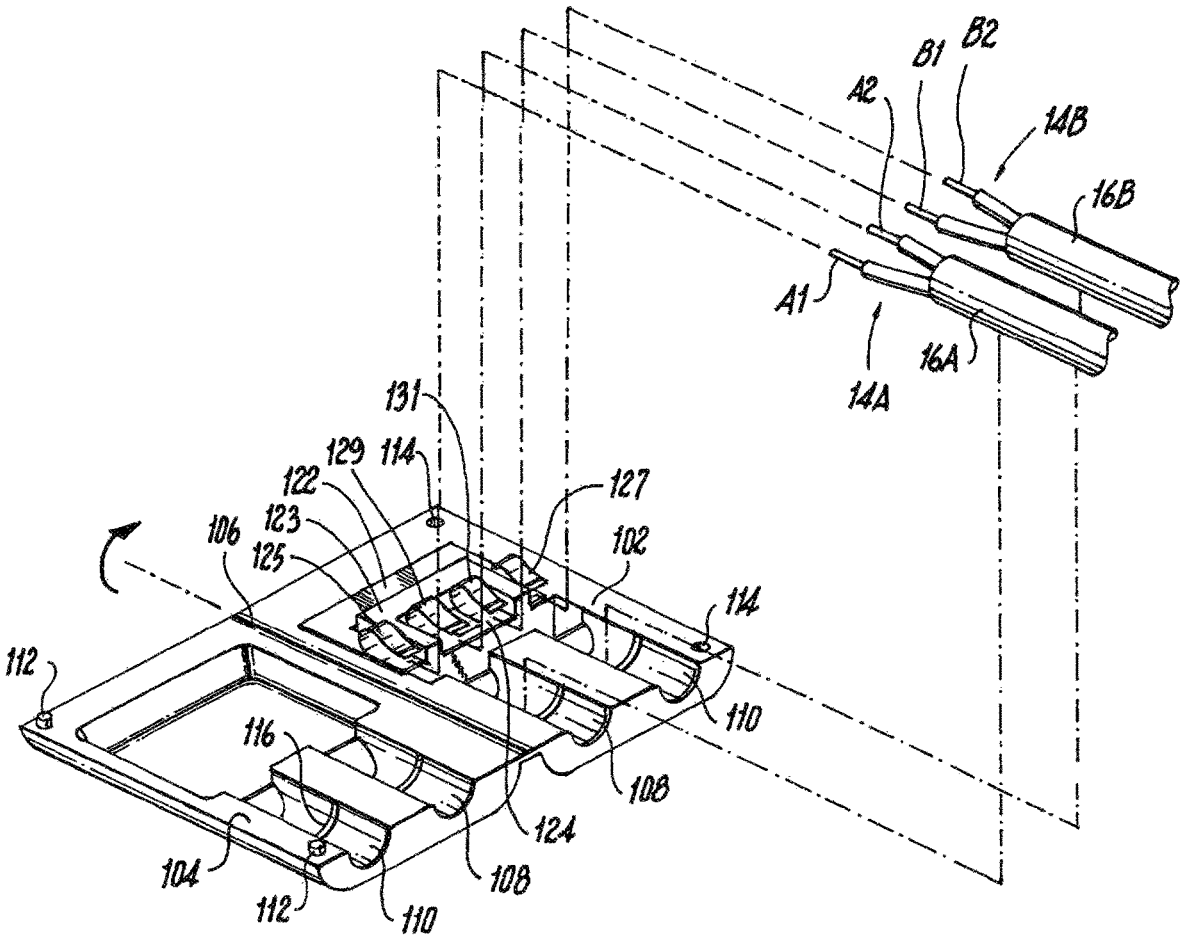
FIG. 3 is a perspective view of a cable connector according to an illustrative embodiment of the present disclosure in the open position.

A cable connector according to an illustrative embodiment of the present disclosure is depicted in FIGS. 2 and 3 and is referred to generally as connector 100. Connector 100 is generally utilized to electrically connect the low voltage wires in insulating jacket 16A to the low voltage wires in insulating jacket 16B. Connector 100 includes a first cover member 102 and a second cover member 104 joined along edge by a living hinge 106. Each cover member 102, 104 includes curved grooves 108 and 110 for receiving the jackets 16A and 16B each surrounding a set of low voltage wires respectively. Raised snaps 112 and corresponding snap recesses 114 are provided for holding cover members 102, 104 together when the connector 100 is closed and snapped shut as depicted in FIG. 2. As shown in FIG. 3, one or more raised ribs 116 may extend across curved grooves 108, 110 of first cover member 102 and/or second cover member 104. Raised ribs 116 grip insulating jackets 16A, 16B when connector 100 is closed. First cover member 102 includes a molded section for receiving electrical jumpers 122 and 124. Jumper 122 includes spring connectors 125, 127. Jumper 124 includes spring connectors 129, 131. Jumper 122 interconnects the control/signal wires A1, B2 within insulating jackets 16A, 16B, respectively. Jumper 124 interconnects the control/signal wires A2, B1 within insulating jackets 16A. 16B, respectively. As shown in FIG. 3, member 102 includes a divider 123 for electrically isolating jumper 122 from jumper 124.

Figure 1:
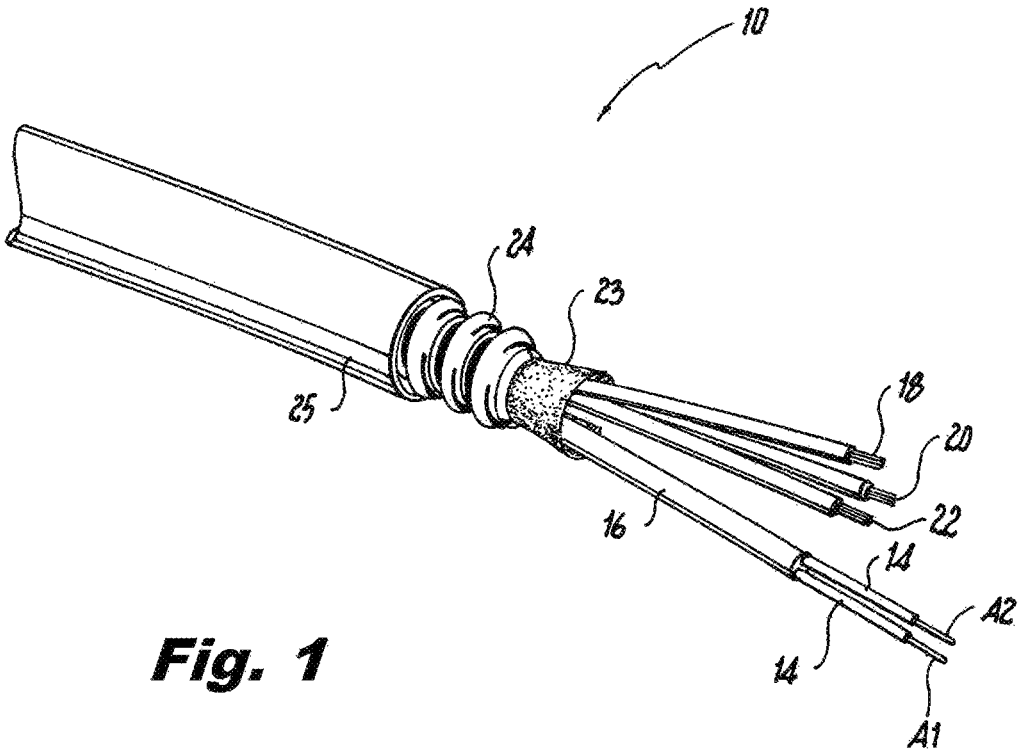
FIG. 1 is a front perspective view of an exemplary cable configuration including multiple line voltage wires and a pair of low voltage control wires utilized for describing illustrative embodiments of the present disclosure.

After the conduits 24 (see FIG. 1) of cables having the low voltage wires to be joined and the line voltage wires are stripped back, the insulating jackets 16A, 16B holding the low voltage wires are also stripped back approximately ¾", the insulating sleeves 14A, 14B covering wires A1, A2, B1, B2 are stripped back approximately ¼". The insulating jackets 16A, 16B are positioned within curved grooves 108, 110, respectively, of cover member 102 and the bare low voltage wires A1, A2, B1, B2 are slid into the appropriate spring connector of jumpers 122, 124 as shown in FIG. 3. Cover member 104 is then closed and pressed until raised snaps 112 and corresponding snap recesses 114 engage and lock cover members 102, 104 together. Connector members 102, 104 may be made of any suitable insulating material. For example, the insulation of connector members 102, 104 is of the same type (e.g., same insulation factor) as the jackets of the line voltage wires, thus complying with the electrical code. Alternatively or in addition, connector 100 is dimensioned to provide a minimum 0.25" physical separation of the control/signal wires from the line voltage wires to comply with the electrical code. Jumpers 122, 124 may be made of any suitable conductor material including copper, steel, spring steel, etc.

A cable connector according to another illustrative embodiment of the present disclosure is shown in FIGS. 4-9 and is referred to generally as connector 150. Connector 150 can be utilized to join up to four sets of control/signal wires. Connector 150 includes connector member 152 and connector member 156 joined by living hinge 160. Connector 150 is placed in the open position depicted in FIG. 5 by moving connector member 152 in the direction of the arrow shown in FIG. 4. Connector member 152 includes four curved groove portions 154A-154D and flat recessed portion 155. Each of curved groove portions 154 may include one or more retaining members such as bumps 157. Bumps 157 may include sharp edges and serve to hold a cable in position when connector 150 is in a closed position. Connector member 156 includes four curved groove portions 158A-158D which correspond to curved groove portions 154A-154D of connector member 152. Curved groove portions may 158 may include one or more retaining members such as bumps 159. Bumps 159 may include sharp edges and serve to hold a cable in position when connector 150 is in the closed position. According to the present illustrative embodiment, connector member 156 is molded to include insulating barriers 168 to electrically isolate jumpers 164 and 166 from each other as shown in FIG. 6. Jumpers 164 and 166 are formed of one or more electrically conductive materials such as, for example, copper, steel, spring steel, etc. Jumper 164 includes three wire clamping member sections 180, 184 and 188 each including an outwardly extending tab 189 as shown in FIG. 6 for receiving and clamping wires in position. Jumper 166 includes two wire clamping member sections 182, 186 for receiving and clamping wires in position. The portion of connector member 156 which retains jumper 164 includes three flared openings 170, 174 and 178 for receiving the wires to be connected via jumper 164. The portion of connector member 156 which retains jumper 166 includes two flared openings 172 and 176 for receiving wires to be connected via jumper 166. Connector member 156 also includes raised hooks 162 which, when connector members 152, 156 are moved into the closed position as shown by the arrow in FIG. 9, latch to surfaces 163 of connector member 152 locking the two members 152, 156 together in the closed position. Connector members 152, 156 may be made of any suitable insulating material. For example, the insulation of connector members 152, 156 is of the same type (e.g., same insulation factor) as the cable jackets of the line voltage wires, thus complying with the electrical code. Alternatively or in addition, connector 150 is dimensioned to provide a minimum 0.25" physical separation of the control/signal wires from the line voltage wires to comply with the electrical code.

Figure 7:
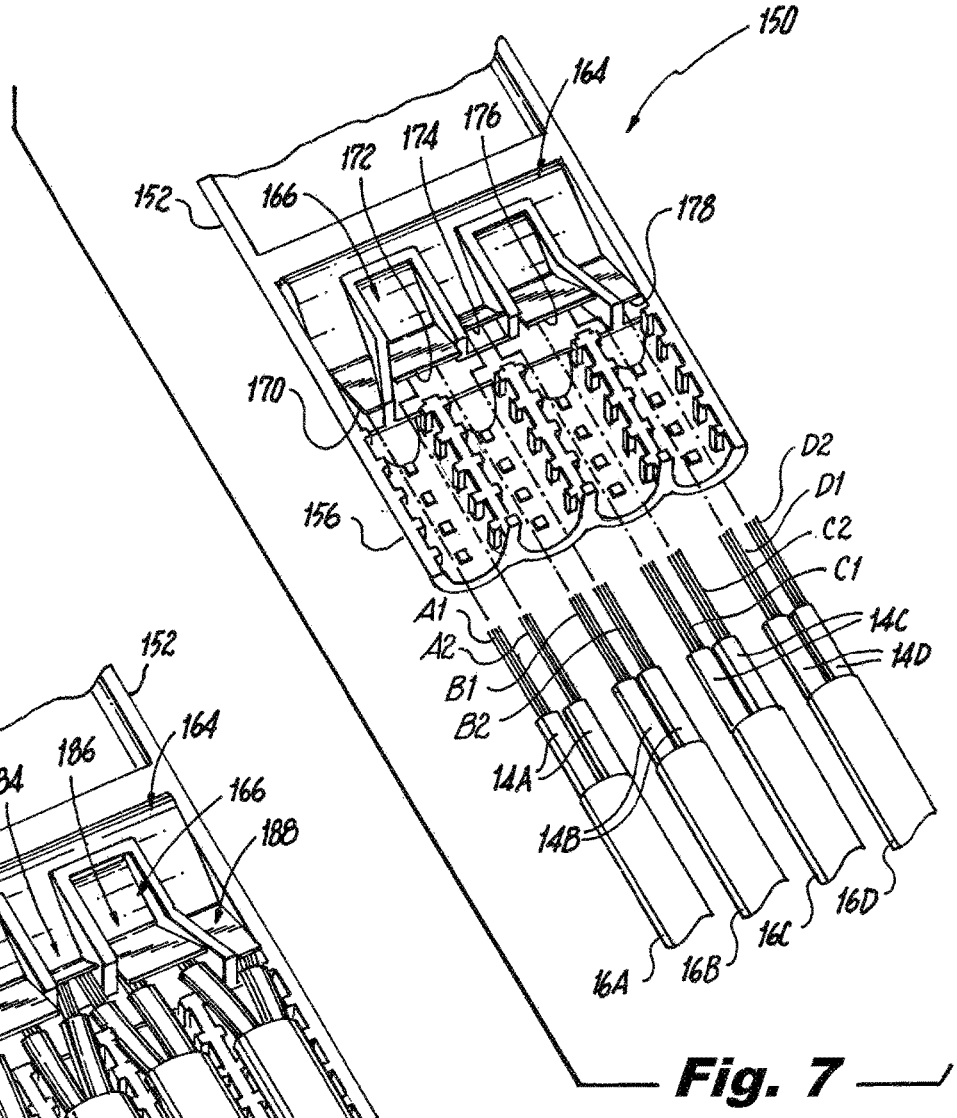
FIG. 7 is a perspective view of a portion of a cable connector according to an illustrative embodiment of the present disclosure.
Figure 8:
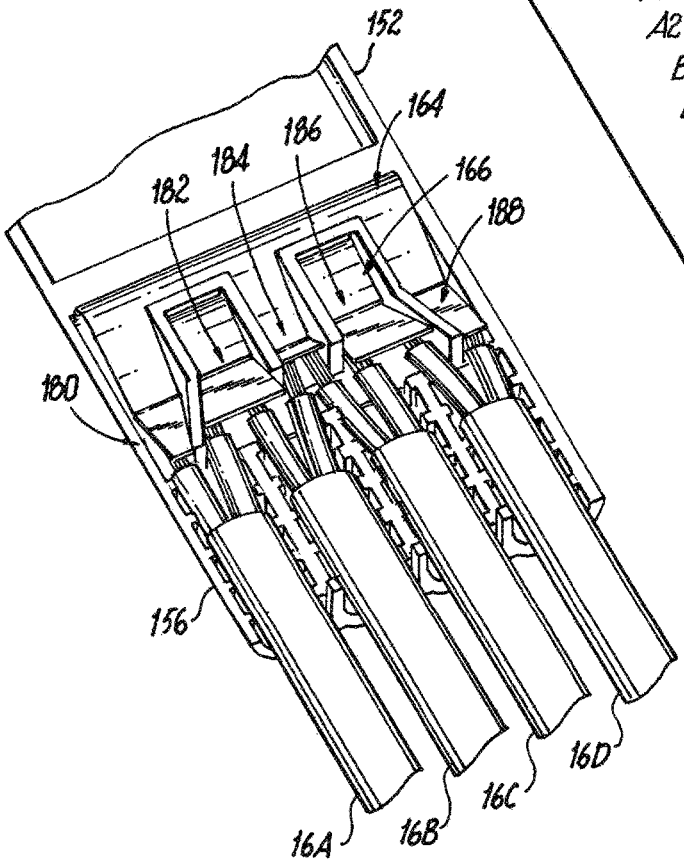
FIG. 8 is a magnified view of a portion of a cable connector according to an illustrative embodiment of the present disclosure.
Figure 9:
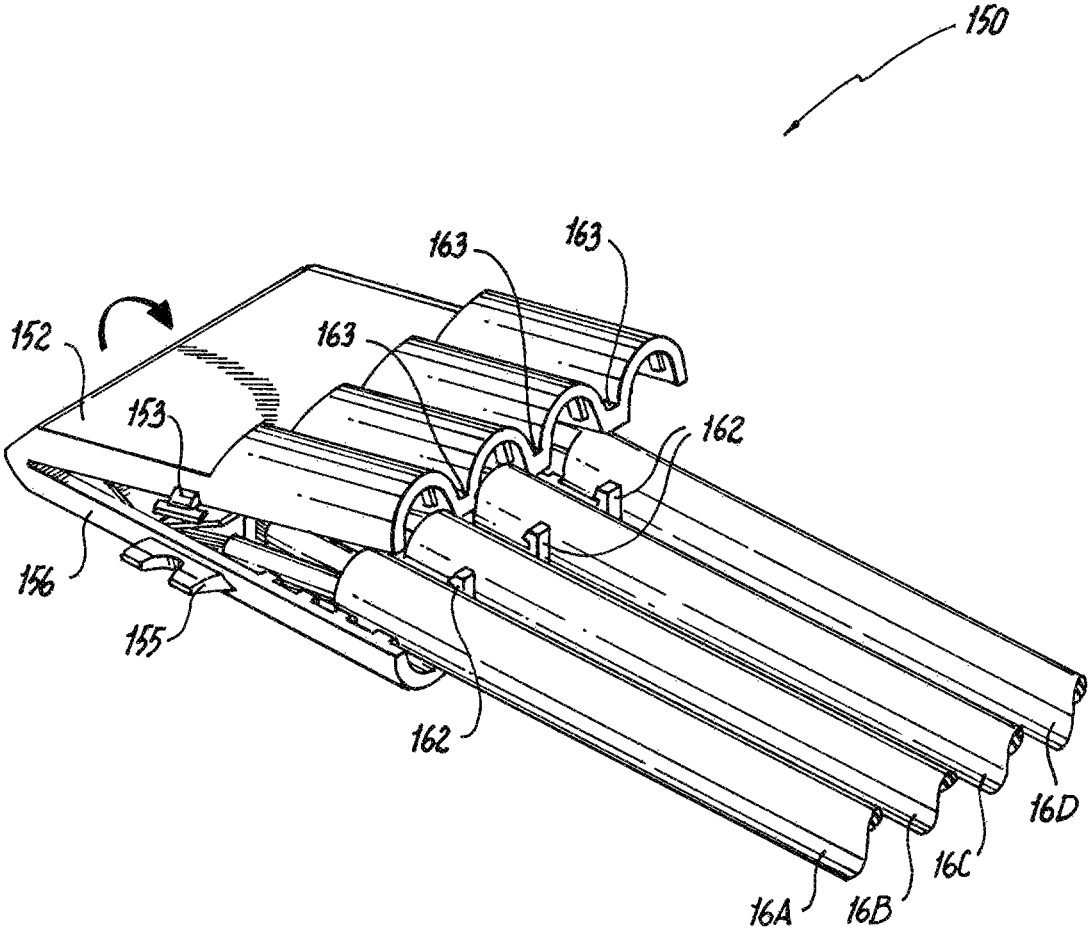
FIG. 9 is perspective view of a cable connector according to an illustrative embodiment of the present disclosure in a partially closed position.

FIGS. 7-9 depict connector 150 being utilized to interconnect four sets of control/signal wires. After the conduits 24 (see FIG. 1) of cables having the low voltage wires to be joined are stripped back, the insulating jackets 16A-16D holding the low voltage wires are also stripped back approximately ¾", the insulating sleeves 14A-14D covering wires A1, A2, B1, B2, C1, C2, D1, D2 are stripped back approximately ¼". The insulating jackets 16A-16D are positioned within curved grooves 158A-158D of connector member 156 and the bare wires A1, A2, B1, B2, C1, C2, D1, D2 are slid into the appropriate spring connector of jumpers 164, 166 as shown in FIG. 8. In more detail, connector 150 is utilized to interconnect wires A1, B2, C1 and D2 together and to interconnect wires A2, B1, C2 and D1 together. The outer covering of cables 40, 42, 44 and 46 are each first stripped back approximately ¾". The outer covering of the control/signal wires are then stripped back approximately ¼". Insulating jacket 16A is positioned within grooved portion 158A and stripped wire A1 is inserted into flared opening 170 and into clamping section 180 of jumper 164. Stripped wire A2 is inserted into flared opening 172 and into clamping section 182 of jumper 166. Insulating jacket 16B is positioned within grooved portion 158B and stripped wire B2 is inserted into flared opening 174 and into clamping section 184 of jumper 164 and stripped wire B1 is inserted into flared opening 172 and into clamping section 182 of jumper 166. Insulating jacket CYC is positioned within grooved portion 158C and stripped wire C1 is inserted into flared opening 174 and into clamping section 184 of jumper 164 and stripped wire C2 is inserted into flared opening 176 and into clamping section 186 of jumper 166. Insulating jacket 16D is positioned within grooved portion 158D and stripped wire D2 is inserted into flared opening 178 and into clamping section 188 of jumper 164 and stripped wire D1 is inserted into flared opening 176 and into clamping section 186 of jumper 166. Connector member 152 is then closed down on connector member 156 by moving connector member 152 in the direction indicated in FIG. 9 until hooks 162 latch flat areas 163 and lock the two connector members together in the closed position. Alternative or additional locking elements may be provided for securing the connector members 152, 156 in the closed position. For example, as shown in FIG. 9, one or more securing flaps 153 may be formed on connector member 152 which are received in one or more flap retaining members 155 extending from connector member 156 for securing the connector members in the closed position.

Figure 10:
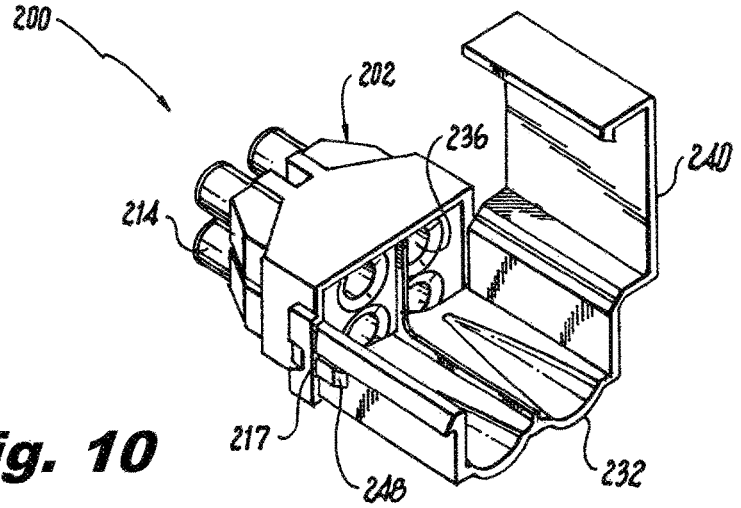
FIG. 10 is a perspective view of a cable connector according to an illustrative embodiment of the present disclosure.
Figure 11:
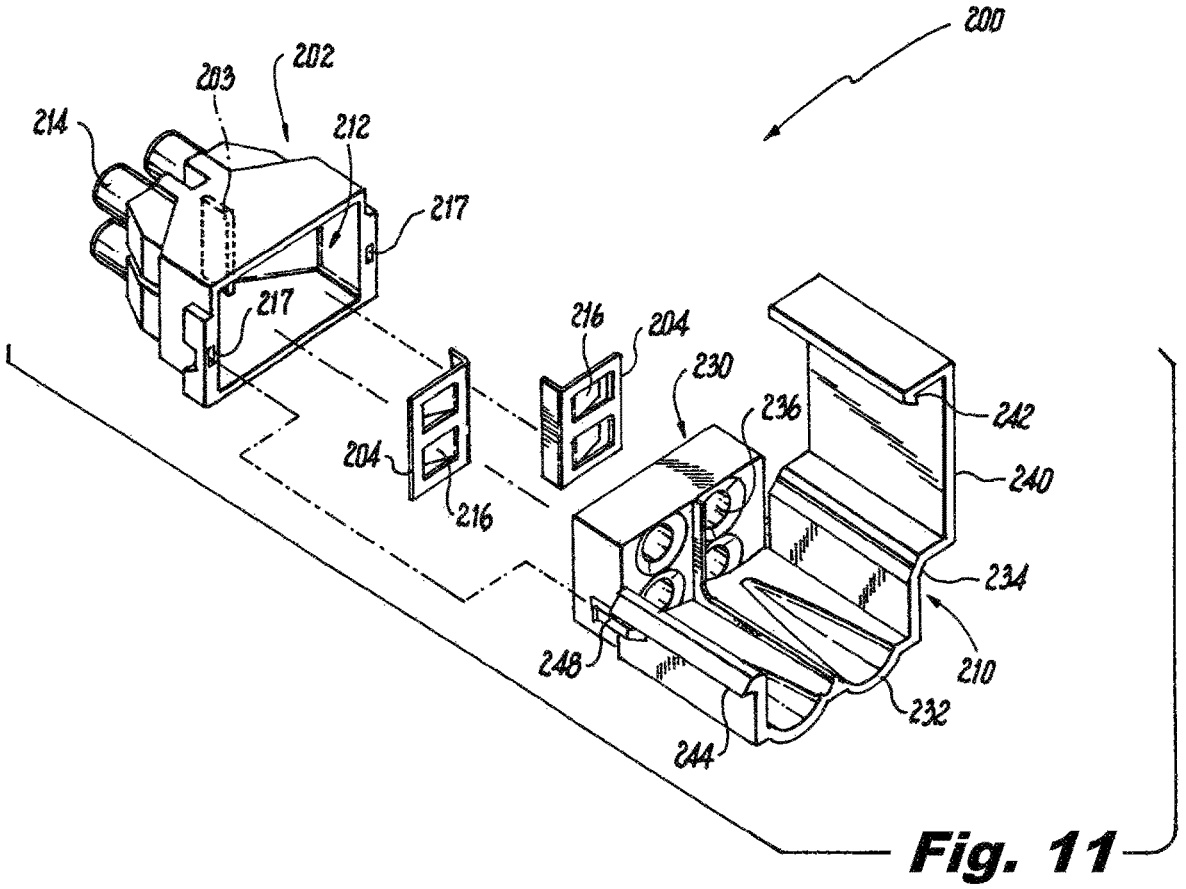
FIG. 11 is an exploded view of a cable connector according to an illustrative embodiment of the present disclosure.
Figure 12:
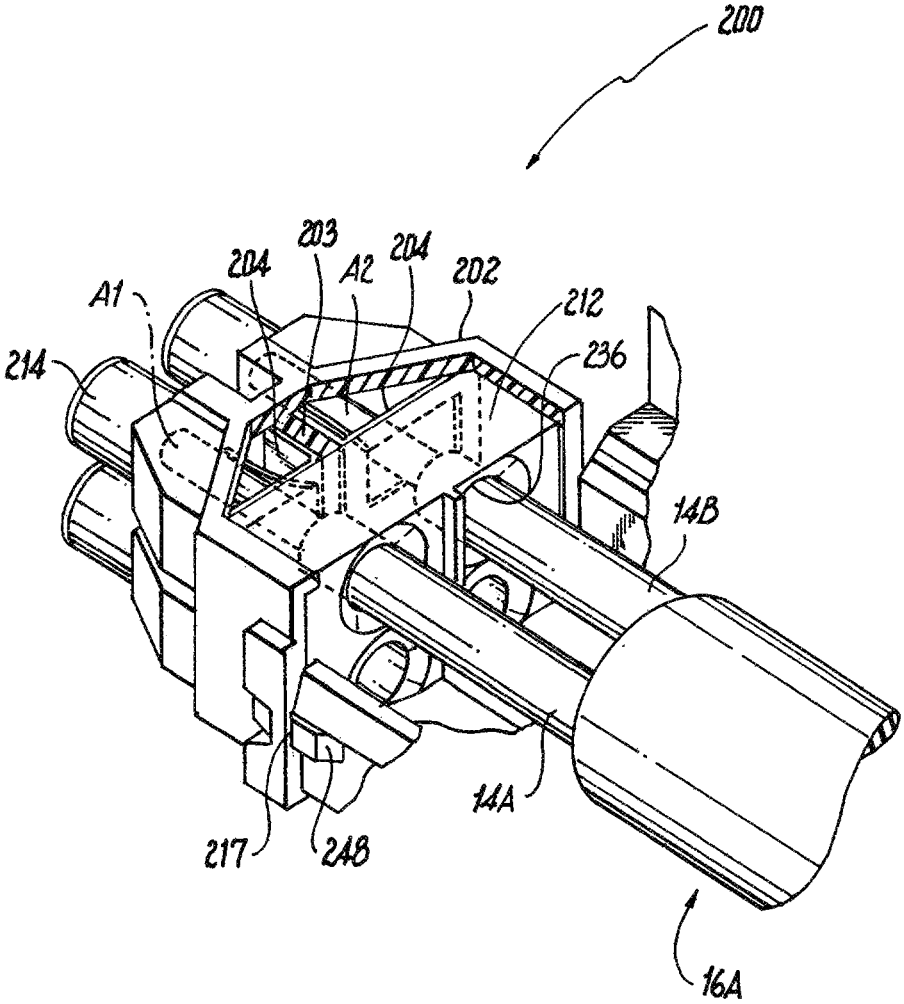
FIG. 12 is a partial cut-away view of a cable connector according to an illustrative embodiment of the present disclosure.

A cable connector according to another illustrative embodiment of the present disclosure is shown in FIGS. 10-12 and is referred to herein as connector 200. Connector 200 is formed generally from housing 202, protective sleeve 210 and jumpers 204. According to the present illustrative embodiment, housing 202 includes a compartment 212 having a divider 203 and communicates with four separate chambers 214. Jumpers 204 are substantially "L" shaped in cross-section and each includes a pair of spring-style contacts 216 for engaging and holding wires. Jumpers 204 may be made of any suitable conductor material including copper, steel, spring steel, etc. Jumpers 204 rest in compartment 212 and are physically kept separate by divider 203 as shown in FIG. 12. Protective sleeve 210 includes a base member 230 having four orifices 236 extending there through and cover members 232, 240 joined by living hinge 234. Cover member 240 includes an inwardly extending latch edge 242 and cover member 232 includes a corresponding outwardly extending latch edge 244. When cover members 232, 240 are pressed together in a closed position, latch edge 242 of cover member 240 rides over latch edge 244 of cover member 232 locking the cover members in the closed position. Base member 230 includes a pair of retaining clips 248 (only one of which is shown) one on each side of base member 230. After jumpers 204 are positioned within compartment 212, base member 230 is pressed into compartment 212 until retaining clips 248 engage and slide through retaining orifices 217 thereby holding base member 230 within compartment 212. Cover members 232, 240 and base member 202 may be made of any suitable insulating material. For example, the insulation of connector members 232, 232 and 202 is of the same type (e.g., same insulation factor) as the jackets of the line voltage wires, thus complying with the electrical code. Alternatively or in addition, connector 200 is dimensioned to provide a minimum 0.25" physical separation of the control/signal wires from the line voltage wires to comply with the electrical code.

Connector 200 is capable of joining up to two sets of low voltage wires, only one of which is depicted in FIG. 12. After the conduits 24 (see FIG. 1) of cables having the low voltage wires to be joined are stripped back, the insulating jacket 16A holding the low voltage wires are stripped back approximately ¾", the insulating sleeves 14 covering wires A1, A2 are stripped back approximately ¼". The bare wires A1, A2 are slid through orifices 236 in base member 202 and through spring style contacts 216. After both sets of low voltage wires are properly positioned, cover member 240 is pressed down until latch edge 242 engages latch edge 244 of cover member 232 locking the cover members in the closed position.

A cable connector according to another illustrative embodiment of the present disclosure is shown in FIGS. 13-15 and is referred to generally as connector 300. Connector 300 is capable of joining up to three sets of low voltage wires. As shown in the exploded view depicted in FIG. 14, connector 300 is formed generally from housing 302, protective sleeves 310, 306 and jumpers 304. According to the present illustrative embodiment, housing 302 is separated into two compartments 312A, 312B. Each compartment 312A, 312B communicates with three separate chambers 314. Jumpers 304 are substantially "L" shaped in cross-section and each includes three spring-style contacts 316 for engaging and holding wires. Jumpers 304 may be made of any suitable conductor material including copper, steel, spring steel, etc. As shown in FIG. 15, jumpers 304 fit within compartments 312A, 312B of housing 302. Edge 320 of jumper 304 rests on inwardly curved portion 322 of housing 302. The other edge 324 of jumper 304 rests in inner edge 326 of housing 302. Protective sleeve 310 includes base member 330 and cover member 332 joined by a living hinge 334. Three orifices 336 extend through base member 330. Base member 330 also includes a pair of clip members 338 extending therefrom (only one of which is shown). Base member 330 is pressed into compartment 312A until clip members 338 engage notches 317 in compartment 312A and locks base member 330 in housing 302. Base member 330 rests on jumper 304 maintaining jumper 304 in position in housing 302. Protective sleeve 306 includes base member 342 and cover member 340 joined by a living hinge 344. Three orifices 346 extend through base member 342. Base member 342 also includes a pair of clip members 318 extending therefrom (only one of which is shown). Base member 342 is pressed into compartment 312B until clip members 318 engage notches 317 in compartment 312B and locks base member 342 in housing 302. Base member 342 rests on jumper 304 maintaining jumper 304 in position in housing 302. Cover members 332, 340 and housing 302 may be made of any suitable insulating material. For example, the insulation of cover members 332, 340 and housing 302 is of the same type (e.g., same insulation factor) as the cable jackets of the line voltage wires, thus complying with the electrical code. Alternatively or in addition, connector 300 is dimensioned to provide a minimum 0.25" physical separation of the control/signal wires from the line voltage wires to comply with the electrical code.

Cables to be interconnected are prepared by stripping the insulating coverings in a manner similar to that described above with respect to FIG. 4-9. The individual wires are slipped through orifices 336,346 until the bare portion of the wire engages and presses past spring-style contacts 316. Spring-style contacts 316 may include sharp edges that prevent the wire from being easily pulled out of the connector. After all wires are inserted in the appropriate position, cover members 332, 340 are folded in toward each other until locking edge extension 354 on cover member 340 enters locking slot 350 on cover member 332 and locking edge extension 352 on cover member 332 enters locking slot 356 on cover member 340.

Figure 16:
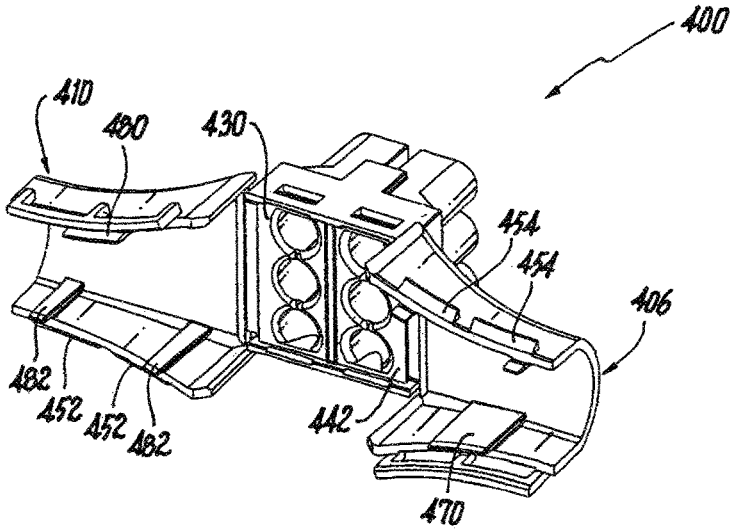
FIG. 16 is a perspective view of a cable connector according to an illustrative embodiment of the present disclosure in the open position.
Figure 17:
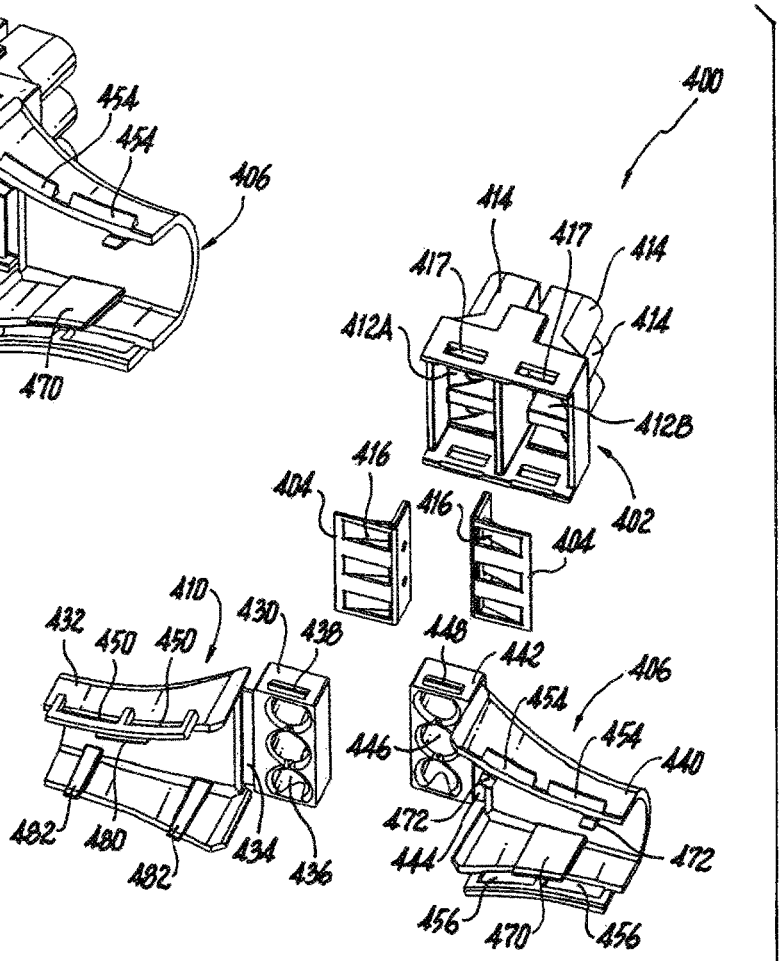
FIG. 17 is an exploded view of a cable connector according to an illustrative embodiment of the present disclosure.
Figure 18:
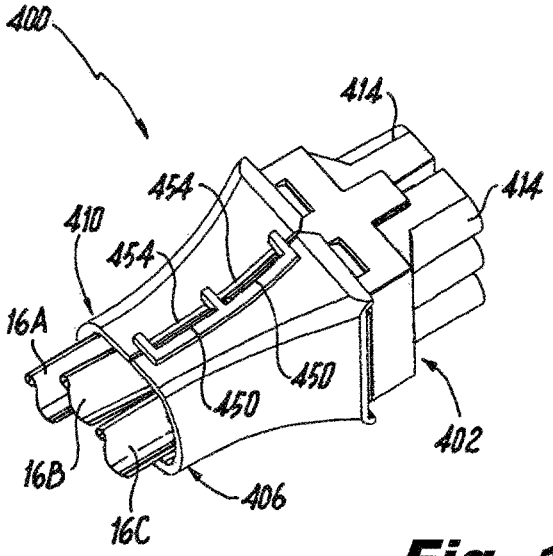
FIG. 18 is a perspective view of a cable connector according to an illustrative embodiment of the present disclosure in the closed position.

A cable connector according to another illustrative embodiment of the present disclosure is shown in FIGS. 16-18 and is referred to generally as connector 400. Connector 400 is capable of joining up to three sets of low voltage wires. As shown in the exploded view depicted in FIG. 17, connector 400 is formed generally from housing 402, protective sleeves 410, 406 and jumpers 404. According to the present illustrative embodiment, housing 402 is separated into two compartments 412A, 412B. Each compartment 412A, 412B communicates with three separate chambers 414. Jumpers 404 are substantially "L" shaped in cross-section and each includes three spring-style contacts 416 for engaging and holding wires. Jumpers 404 may be made of any suitable conductor material including copper, steel, spring steel, etc. Jumpers 404 fit within compartments 412A, 412B of housing 402 in a manner similar to that described above with respect to FIGS. 13-15. Protective sleeve 410 includes base member 430 and cover member 432 joined by a living hinge 434. Three orifices 436 extend through base member 430. Base member 430 also includes a pair of clip members 438 extending therefrom (only one of which is shown). Base member 430 is pressed into compartment 412A until clip members 438 engage notches 417 in compartment 412A and locks base member 430 in housing 402. Base member 430 rests on jumper 404 maintaining jumper 404 in position in housing 402. Protective sleeve 406 includes base member 442 and cover member 440 joined by a living hinge 444. Three orifices 446 extend through base member 442. Base member 442 also includes a pair of clip members 448 extending therefrom (only one of which is shown). Base member 442 is pressed into compartment 412B until clip members 448 engage notches 417 in compartment 412B and locks base member 442 in housing 402. Base member 442 rests on jumper 404 maintaining jumper 404 in position in housing 402.

Cables to be interconnected are prepared by stripping the insulating coverings in a manner similar to that described above with respect to FIG. 4-9. The individual wires are slipped through orifices 436,446 until the bare portion of the wire engages and presses past spring-style contacts 416. Spring-style contacts 416 may include sharp edges that prevent the wire from being easily pulled out of the connector. After all wires are inserted in the appropriate position, cover members 432, 440 are folded in toward each other until locking edge extensions 454 on cover member 440 enter locking slots 450 on cover member 432 and locking edge extensions 452 on cover member 432 enter locking slots 456 on cover member 440.

Cover member 440 includes a pair of retaining members 472 positioned and extending from the inner edge of cover member 440 having locking edge extensions 454. Cover member 440 also includes a retaining member 470 positioned and extending from the inner edge of cover member 440 having locking slots 456. Cover member 432 includes a pair of retaining members 482 positioned and extending from the inner edge of cover member 432 having locking edge extensions 452. Cover member 432 also includes a retaining member 480 positioned and extending from the inner edge of cover member 432 having locking slots 450. When connector 400 is in the closed position as shown in FIG. 18, retaining members 472 and 470 engage the inside edges of cover member 432 and retaining members 482 and 480 engage the inside edges of cover member 440 providing secure and positive seating of the corresponding edges of cover members 432, 440. Cover members 432, 440 may be made of any suitable insulating material. For example, the insulation of cover members 432, 440 is of the same type (e.g., same insulation factor) as the cable jackets of the line voltage wires, thus complying with the electrical code. Alternatively or in addition, connector 400 is dimensioned to provide a minimum 0.25" physical separation of the control/signal wires from the line voltage wires to comply with the electrical code.

Figure 19A:
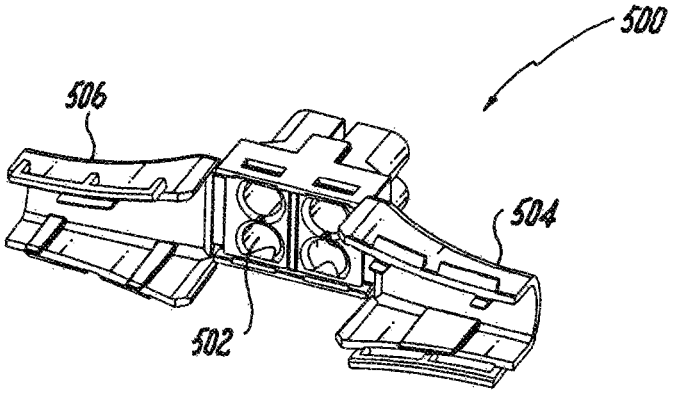
FIGS. 19*a*-19*c* are perspective views of cable connectors according to various illustrative embodiments of the present disclosure.
Figure 19B:
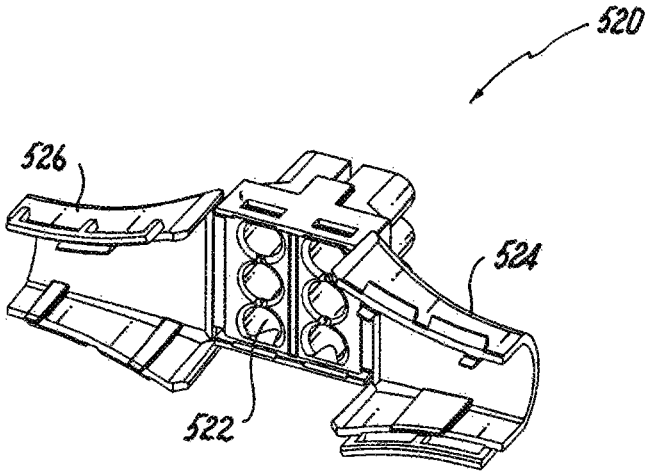
Figure 19C:
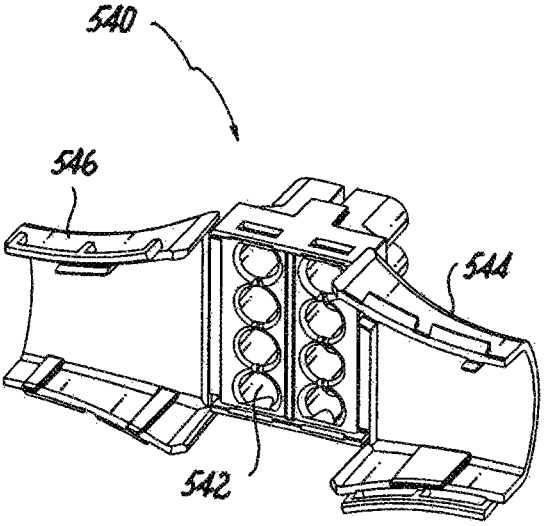

Cable connectors may be dimensioned to accept and join any number of wires. For example, illustrative embodiments of the present disclosure utilized to join various numbers of wires are shown in FIGS. 19*a*-19*c*. As shown in FIG. 19*a*, connector 500 includes four receptacles 502 for receiving and joining up to two pair of low voltage wires. Protective sleeve members 506, 504 are dimensioned to receive up to two cables each including a pair of wires. Connector 500 may be made of any suitable insulating material. For example, the insulation of connector 500 is of the same type (e.g., same insulation factor) as the cable jackets of the line voltage wires, thus complying with the electrical code. Alternatively or in addition, connector 500 is dimensioned to provide a minimum 0.25" physical separation of the control/signal wires from the line voltage wires to comply with the electrical code.

As shown in FIG. 19*b*, connector 520 includes six receptacles 522 for receiving and joining up to three pair of low voltage wires. Protective sleeve members 526, 524 are dimensioned to receive up to three cables each including a pair of wires. Connector 520 may be made of any suitable insulating material. For example, the insulation of connector 520 is of the same type (e.g., same insulation factor) as the cable jackets of the line voltage wires, thus complying with the electrical code. Alternatively or in addition, connector 520 is dimensioned to provide a minimum 0.25" physical separation of the control/signal wires from the line voltage wires to comply with the electrical code.

As shown in FIG. 19*c*, connector 540 includes eight receptacles 542 for receiving and joining up to four pair of low voltage wires. Protective sleeve members 546, 544 are dimensioned to receive up to four cables each including a pair or wires. Connector 542 may be made of any suitable insulating material. For example, the insulation of connector 542 is of the same type (e.g., same insulation factor) as the cable jackets of the line voltage wires, thus complying with the electrical code. Alternatively or in addition, connector 540 is dimensioned to provide a minimum 0.25" physical separation of the control/signal wires from the line voltage wires to comply with the electrical code. It will be appreciated that connectors may be provided with any suitable number of receptacles and/or dimensioned to receive and join any suitable number of wires or cables.

Figure 20:
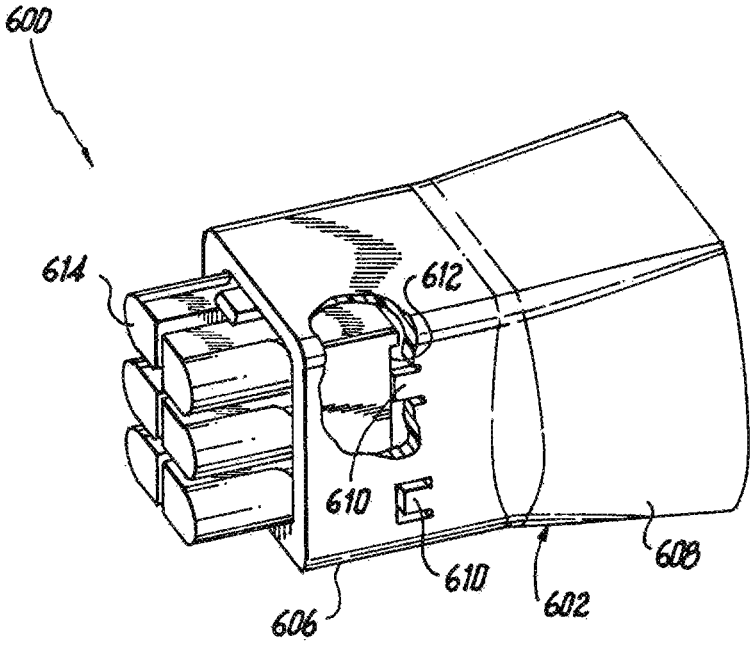
FIG. 20 is a perspective view of a cable connector according to an illustrative embodiment of the present disclosure.
Figure 21:
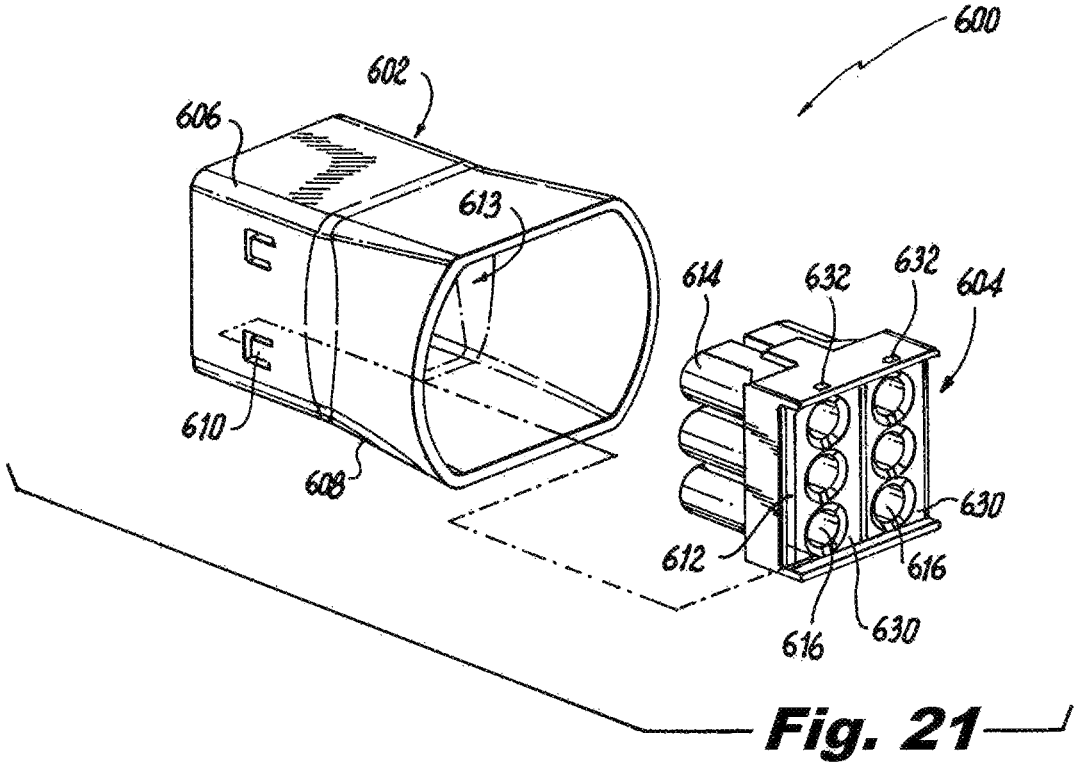
FIG. 21 is a partial exploded view of a cable connector according to an illustrative embodiment of the present disclosure.
Figure 22:
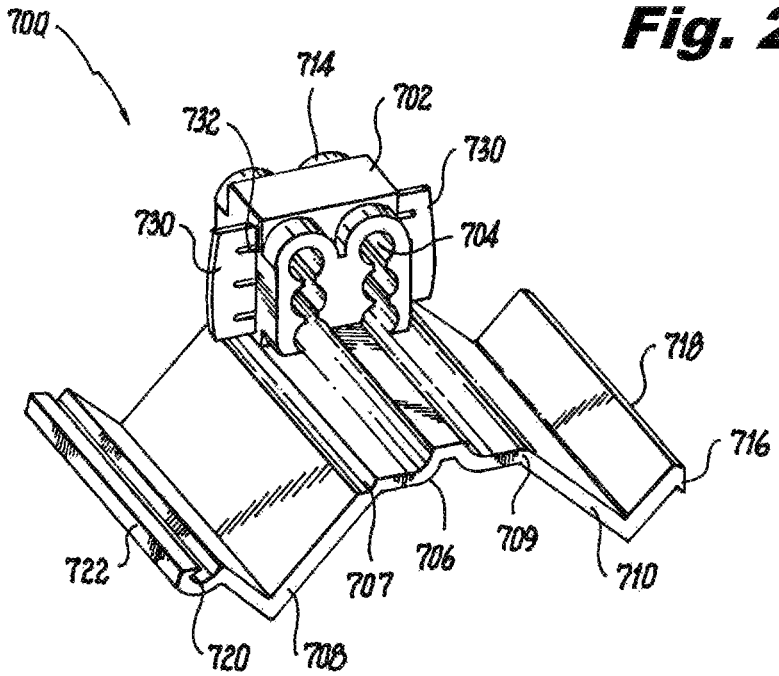
FIG. 22 is a perspective view of a cable connector according to an illustrative embodiment of the present disclosure.

A cable connector according to another illustrative embodiment of the present disclosure is shown in FIGS. 20, 21 and is referred to generally as connector 600. Connector 600 includes a unitary housing/protective sleeve referred to generally as main housing 602 and a wire receptacle unit 604 referred to generally as receptacle 604. Main housing 602 includes a housing receptacle portion 606 and a protective sleeve portion 608. Receptacle 604 is similar to housing 302 described above with respect to FIGS. 13-15 and includes a chamber for receiving base member 630. It will be appreciated that base member 630 may be provided as two separate units or as one unit. Although not shown, receptacle 604 has a pair of jumpers similar to jumpers 304 described above with respect to FIGS. 13-15 which reside below base member 630. Orifices 616 extend through the one or more base members 630 allowing wires to be inserted there through and into the appropriate jumper. Receptacle 604 includes notches 632 which receive clip members (not shown) formed on the one or more base members 630. A pair of inwardly extending clips 610 are provided on each side of housing receptacle 606 which engage edge 612 of receptacle 604 and hold receptacle 604 in position within the housing receptacle 606.

Cables to be interconnected utilizing connector 600 are prepared by stripping the insulating coverings in a manner similar to that described above with respect to FIG. 4-9. The individual wires are slipped into orifices 616 until the bare portions of the wires engage and press past the spring-style contacts (not shown) within receptacle 604. The spring-style contacts may include sharp edges that prevent the wire from being easily pulled out of the connector. When all wires are properly inserted in the appropriate position, the bare wires will reside within the spring-style contacts and the stripped portions of the individual wires will reside within orifices 616. The portion of the cable stripped to expose the individual wires will reside within protective sleeve 608. Main housing 602 and receptacle 604 may be made of any suitable insulating material. For example, the insulation of main housing 602 and receptacle 604 is of the same type (e.g., same insulation factor) as the cable jackets of the line voltage wires, thus complying with the electrical code. Alternatively or in addition, main housing 602 and/or receptacle 604 are dimensioned to provide a minimum 0.25" physical separation of the control/signal wires from the line voltage wires to comply with the electrical code.

Figure 23:
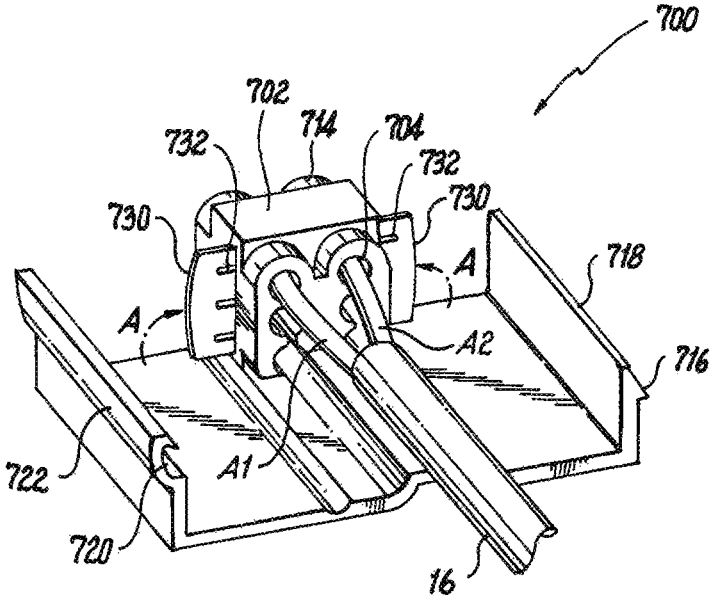
FIG. 23 is a perspective view of a cable connector according to an illustrative embodiment of the present disclosure.
Figure 24:
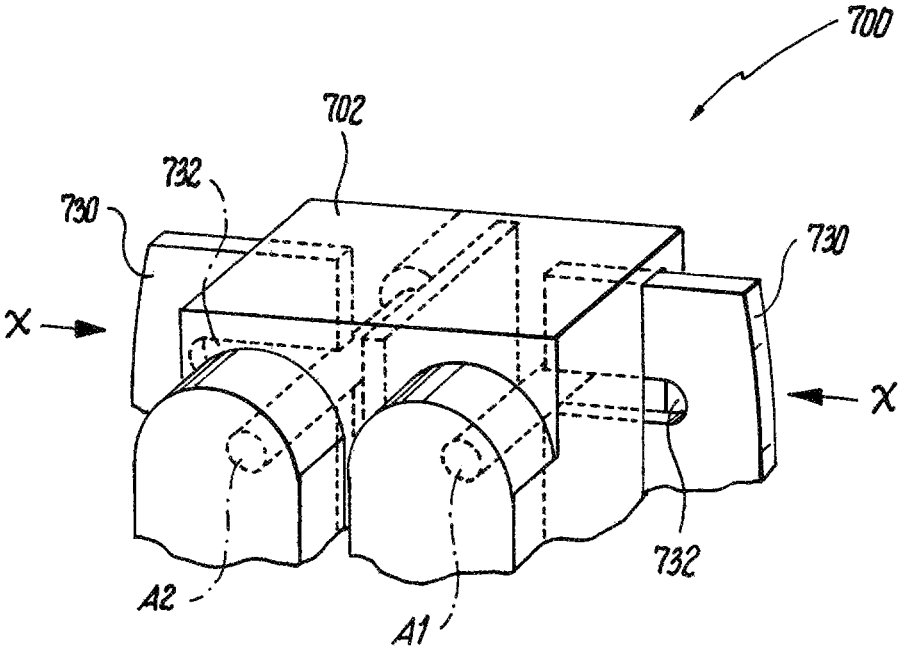
FIG. 24 is a partial enlarged view of a portion of a cable connector according to an illustrative embodiment of the present disclosure.
Figure 25:
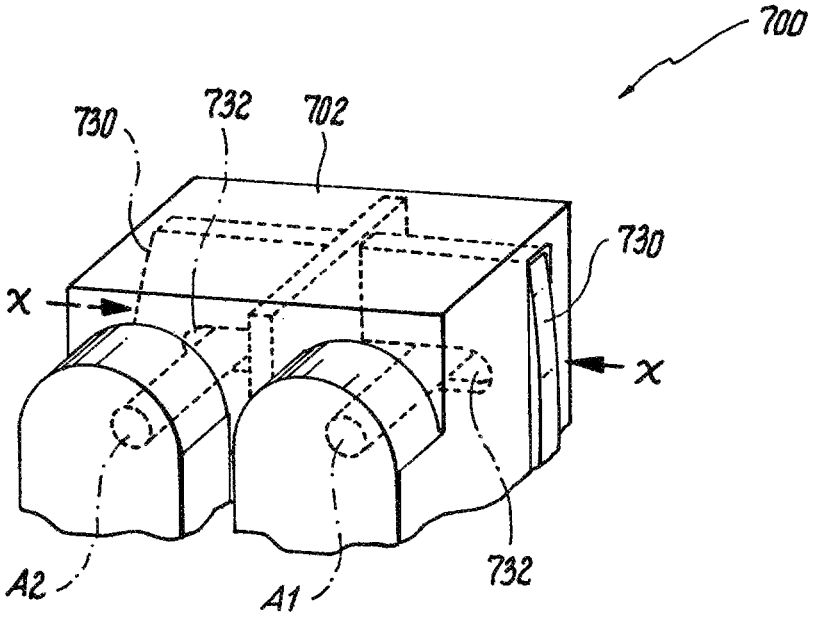
FIG. 25 is a partial enlarged view of a portion of a cable connector according to an illustrative embodiment of the present disclosure.

A cable connector according to another illustrative embodiment of the present disclosure is shown in FIGS. 22-25 and is referred to generally as connector 700. Connector 700 is formed as a single unit including base member 702 having six orifices 704 each communicating with a corresponding chamber 714. A base cover member 706 extends from base member 702. Base cover member 706 is attached to cover members 708 and 710 by living hinges 707, 709, respectively. Cover member 710 includes a latch hook 716 formed along edge 718. Cover member 708 includes a corresponding latch receptacle 720 formed along edge 722. When cover members 708 and 710 are rotated in the directions indicated by arrows "A" (FIG. 23), latch hook 716 can be received and press fit into latch receptacle 720 for locking cover members 708, 710 together. Base member 702 includes a pair of side slots for receiving splice plates 730. Splice plates 730 each include three slots 732 dimensioned to receive a wire. According to an embodiment of the present disclosure, slots 732 are dimensioned to receive a bare wire. Alternatively, the slots 732 are slightly smaller than a diameter of the bare wire and have sharp edges that are capable of cutting through any insulation on the wire and making electrical contact with the wire. As shown in FIG. 23, low voltage wires A1, A2 (stripped or unstripped) are inserted through orifices 704 and into chambers 714. After all wires are appropriately positioned, splice plates 730 are pressed inward in the direction indicated by arrows "X" (FIG. 24). Slots 732 will cut slightly into wires A1, A2 making electrical contact with and providing a secure connection to the wires. After splice plates 730 are completely inserted into base member 702 (see FIG. 25), cover members 708 and 710 are rotated in the directions indicated by arrows "A" as shown in FIG. 23 and the cover members are latched together. Connector 700 may be made of any suitable insulating material. For example, the insulation of connector 700 is of the same type (e.g., same insulation factor) as the cable jackets of the line voltage wires, thus complying with the electrical code. Alternatively or in addition, connector 700 is dimensioned to provide a minimum 0.25" physical separation of the control/signal wires from the line voltage wires to comply with the electrical code.

The insulation protection of the connectors described herein satisfies the second prong of the electrical code. That is, once in place in the connectors the control wires have the same insulation factor as those of line voltage wires. Accordingly, the connectors described herein can satisfy the electrical code without providing the 0.25" separation of the low voltage wires from the line voltage wires. Of course, as noted above, the connectors may be designed to also provide the 0.25" separation of the low voltage wires from the line voltage wires if desired.

It will be appreciated that different portions of the connectors described herein may have different thicknesses and still satisfy the insulation factor requirement. For example, the line voltage wires are generally coated with a 30 mil jacket of PVC. If the connector is formed from PVC, portions of the connector covering the bare low voltage wires should have at least the same insulation factor as the line voltage wires. That is, these portions of the connector should generally be at least 30 mil thick. Portions of the connector covering the unstripped low voltage wires may have less of an insulation factor, as long as the cumulative thickness of the connector and the jacket covering the low voltage wires is at least 30 mil thick. For example, assuming the low voltage wires are covered with a 15 mil jacket, these portions of the connector should generally be at least 15 mil thick.

Numerous additional modifications and variations of the present disclosure are possible in view of the above-teachings. It is therefore to be understood that within the scope of the appended claims, the present disclosure may be practiced other than as specifically described herein. For example, elements and/or features of different illustrative embodiments may be combined with each other and/or substituted for each other within the scope of this disclosure and appended claims.

What is claimed is:

1. A connector for connecting control conductors provided in conduits also containing power conductors, the connector comprising:

a main housing; and a wire receptacle assembly including:

a receptacle housing having at least one compartment in communication with at least one chamber;

at least one base member adapted to fit within the at least one compartment, the at least one base member having a plurality of wire orifices extending therethrough, the plurality of orifices being aligned with the at least one chamber; and at least one jumper positioned within the at least one compartment between the at least one chamber and the at least one base member such that the at least one jumper is aligned with the plurality of wire orifices and capable of connecting at least one conductor to another conductor within the receptacle housing;

wherein the receptacle housing is adapted to fit at least partially within the main housing and to extend at least partially outside the main housing, and wherein the receptacle housing is adapted to be attached to the main housing.

2. The connector according to claim 1, wherein the wherein the receptacle housing is adapted to be releasably attached to the main housing.

3. The connector according to claim 1, wherein the at least one base member is adapted to be releasably attached within the at least one compartment of the receptacle housing.

4. The connector according to claim 1, wherein the at least one jumper comprises at least one spring-style connector or a splice plate.

5. The connector according to claim 1, wherein the at least one jumper comprises a plurality spring-style connectors.

6. A connector for connecting control conductors provided in conduits also containing power conductors, the connector comprising:

a main housing including:

a receptacle portion having a first main opening and a second main opening; and a sleeve portion having a first sleeve opening in communication with the first main opening of the receptacle portion and a second sleeve opening;

a wire receptacle assembly including:

a receptacle housing having at least one compartment in communication with at least one chamber;

at least one base member adapted to fit within the at least one compartment, the at least one base member having a plurality of wire orifices extending therethrough, the plurality of orifices being aligned with the at least one chamber; and at least one jumper positioned within the at least one compartment between the at least one chamber and the at least one base member such that the at least one jumper is at least partially aligned with at least one of the plurality of wire orifices and capable of connecting at least one conductor to another conductor within the receptacle housing; and wherein the receptacle housing is adapted to fit at least partially within and to be attached to the receptacle portion of the main housing.

7. The connector according to claim 6, wherein the wherein the receptacle housing is releasably attached to the main housing.

8. The connector according to claim 6, wherein when the receptacle housing is releasably attached to the receptacle portion of the main housing the at least one chamber extends through the second main opening in the main housing.

9. The connector according to claim 6, wherein the plurality of wire orifices extending through the at least one base member comprises a first orifice and a second orifice, and wherein the first orifice is aligned with a first chamber and the second orifice is aligned with a second chamber.

10. The connector according to claim 6, wherein the plurality of wire orifices extending through the at least one base member comprises a first orifice, a second orifice and a third orifice, and wherein the first orifice is aligned with a first chamber, the second orifice is aligned with a second chamber and the third orifice is aligned with a third chamber.

11. The connector according to claim 6, wherein the at least one base member is adapted to be releasably attached within the at least one compartment of the receptacle housing.

12. The connector according to claim 6, wherein the at least one jumper comprises at least one spring-style connector or a splice plate.

13. The connector according to claim 6, wherein the at least one jumper comprises a plurality spring-style connectors.

14. The connector according to claim 6, wherein the at least one base member comprises a first base member having a plurality of wire orifices extending therethrough and a second base member having a plurality of wire orifices extending therethrough, wherein the first base member is positioned adjacent the second base member.

15. The connector according to claim 14, wherein the plurality of wire orifices extending through the first base member comprises a first orifice and a second orifice, and wherein the first orifice is aligned with a first chamber and the second orifice is aligned with a second chamber.

16. The connector according to claim 14, wherein the plurality of wire orifices extending through the first base member comprises a first orifice, a second orifice and a third orifice, and wherein the first orifice is aligned with a first chamber, the second orifice is aligned with a second chamber and the third orifice is aligned with a third chamber.

17. The connector according to claim 14, wherein the plurality of wire orifices extending through the second base member comprises a first orifice and a second orifice, and wherein the first orifice is aligned with a first chamber and the second orifice is aligned with a second chamber.

18. The connector according to claim 14, wherein the plurality of wire orifices extending through the second base member comprises a first orifice, a second orifice and a third orifice, and wherein the first orifice is aligned with a first chamber, the second orifice is aligned with a second chamber and the third orifice is aligned with a third chamber.

19. A connector for electrically connecting control conductors provided in conduits also containing power conductors, the connector comprising:

a main housing having a receptacle portion and a sleeve portion, wherein the receptacle portion has a main opening and the sleeve portion has a sleeve opening;

a wire receptacle assembly including:

a receptacle housing having a plurality of compartments, each of the plurality of compartments being in communication with at least one chamber;

a plurality of base members, wherein one of the plurality of base members is adapted to fit within one of the plurality of compartments, each base member having at least one wire guide extending therethrough; and a plurality of jumpers, wherein one of the plurality of jumpers is positioned within one of the plurality of compartments between the at least one chamber and one of the plurality of base members such that each jumper is at least partially aligned with the at least one wire guide extending through the respective base member; and wherein the receptacle housing is adapted to fit at least partially within and to be attached to the receptacle portion of the main housing.

20. The connector according to claim 19, wherein the wherein the receptacle housing releasably attached to the main housing.

21. The connector according to claim 19, wherein when the receptacle housing is releasably attached to the receptacle portion of the housing each at least one chamber extends through the main opening in the receptacle portion.

22. The connector according to claim 19, wherein the at least one wire guide extending through the at least one base member comprises a first orifice and a second orifice, and wherein the first orifice is aligned with a first chamber and the second orifice is aligned with a second chamber.

23. The connector according to claim 19, wherein the at least one wire guide extending through the at least one base member comprises a first orifice, a second orifice and a third orifice, and wherein the first orifice is aligned with a first chamber, the second orifice is aligned with a second chamber and the third orifice is aligned with a third chamber.

24. The connector according to claim 19, wherein each base member is adapted to be releasably attached within its respective compartment.

25. The connector according to claim 19, wherein the at least one jumper comprises at least one spring-style connector or a splice plate.

26. The connector according to claim 19, wherein the at least one jumper comprises a plurality of spring-style connectors.

27. The connector according to claim 19, wherein the plurality of base members comprise a first base member having a plurality of wire guides extending therethrough and a second base member having a plurality of wire guides extending therethrough, wherein the first base member is positioned adjacent the second base member.

* * * * *